United States Patent [19]

Rugh et al.

[11] Patent Number: 4,660,406

[45] Date of Patent: Apr. 28, 1987

[54] DIE MANIPULATOR

[75] Inventors: Clyde J. Rugh; John L. King, Jr.; Francis M. Tuttle, all of Owosso; William E. Jones, Durand, all of Mich.

[73] Assignee: MWA Company, Owosso, Mich.

[21] Appl. No.: 763,540

[22] Filed: Aug. 8, 1985

Related U.S. Application Data

[63] Continuation-in-part of Ser. No. 725,934, Apr. 22, 1985.

[51] Int. Cl.[4] ..... B21J 13/12

[52] U.S. Cl. ..... 72/448; 248/661; 269/71; 269/45; 100/918; 414/665; 414/669; 414/364

[58] Field of Search ..... 414/763, 786, 783, 364, 414/665, 669; 72/455, 456, 448, 39, 462, 40; 100/918; 248/647, 661, 129, 652; 269/43, 45, 71

[56] References Cited

U.S. PATENT DOCUMENTS

| | | | |
|---|---|---|---|
| 3,096,889 | 7/1963 | Vekovius et al. . | |
| 3,111,100 | 11/1963 | Georgeff | 72/455 |
| 3,182,817 | 5/1965 | Figley . | |
| 3,230,869 | 1/1966 | Wikins | 100/214 |
| 3,422,661 | 1/1967 | Blackhurst | 72/448 |
| 3,551,982 | 9/1968 | Bratton | 269/45 |
| 3,610,439 | 10/1971 | Hopkins . | |
| 3,742,572 | 7/1973 | Lucas | 269/43 |
| 3,796,011 | 3/1974 | Hopkins . | |
| 3,979,939 | 9/1976 | Pazderka | 72/239 |
| 4,305,692 | 12/1981 | Brauer | 414/786 |

FOREIGN PATENT DOCUMENTS

| | | | |
|---|---|---|---|
| 18663 | 2/1977 | Japan | 414/783 |
| 97959 | 8/1979 | Japan | 414/763 |
| 518245 | 10/1974 | U.S.S.R. | 72/239 |
| 1036416 | 8/1983 | U.S.S.R. | 72/239 |

*Primary Examiner*—Robert L. Spruill
*Assistant Examiner*—David B. Jones
*Attorney, Agent, or Firm*—Barnes, Kisselle, Raisch, Choate, Whittemore & Hulbert

[57] ABSTRACT

An apparatus for manipulating the upper and lower dies of a die set comprising a gantry having a fixture mounted on a main frame for up and down movement, and a sub-frame mounted on the fixture for 180° of rotation. Clamping units are mounted on the sub-frame for clamping the upper die to the sub-frame when the fixture is in a lower position at a work-transfer station. The die set is transported on a cart to the work-transfer station where the upper die is clamped to the sub-frame. The fixture is raised to elevate the upper die to an upper position. The cart is moved away from the work-transfer station carrying only the lower die with it. The upper die is inverted, lowered onto a second cart and it, too, is then moved away from the work-transfer station. Both dies now face upwardly for convenient inspection, cleaning and/or repair. The transporter cart table on which the die set is supported can be rotated to any desired angle such as 90°, so that after the upper die has been removed, the lower die may be turned to a position suitable for inspection, cleaning and/or repair.

17 Claims, 32 Drawing Figures

DIE MANIPULATOR

REFERENCE TO RELATED APPLICATION

This application is a continuation-in-part of our prior copending application Ser. No. 725,934 filed Apr. 22, 1985.

This invention relates generally to apparatus for manipulating a workpiece, and refers more particularly to a manipulator for raising, inverting, and lowering a die or the like.

SUMMARY OF THE INVENTION

From time to time, it is necessary to carry out repair and maintenance procedures on dies of the type used to shape large metal stampings such as those used for example in the automotive industry. In order to repair the upper die of a die set, it is desirable and often necessary to invert the upper die in order to carry out the necessary procedures. The apparatus of this invention is designed particularly for inverting the upper die of a die set so that it may be repaired or maintained.

In accordance with a specific embodiment of the invention about to be described, the manipulator apparatus comprises a main frame, a fixture mounted on the main frame for up and down movement, and a sub-frame mounted on the fixture for 180° rotation. Clamping means are provided on the sub-frame for clamping a workpiece such as a die or the like to the sub-frame when the fixture is in a lower position at a work transfer station. Means are provided for raising the fixture to elevate the workpiece to an upper position and for rotating the sub-frame 180° to invert the workpiece. Thereafter the fixture is lowered back to the lower position and the clamping means is released to return the workpiece to the work transfer station in an inverted position. Instead of rotating the sub-frame a full 180°, it may be rotated to any angle less than 180°, such, for example, as 90°, so that the workpiece may be inspected and/or cleaned.

The workpiece being manipulated, as stated above, is preferably the upper die of a die set. The die set is transported on a cart to the work transfer station where the upper die is elevated. Then the cart is moved away from the work transfer station carrying only the lower die with it. The upper die is inverted, lowered onto a second cart and it, too, is then moved away from the work transfer station. Both dies now face upwardly for convenient inspection, cleaning and/or repair.

Further in accordance with the invention, the cart table on which the die set is supported, may be capable of being rotated to any desired angle, such as 90°, so that after the upper die has been removed, the lower die may be turned to a position suitable for inspection and/or cleaning.

These and other objects of the invention will become more apparent as the following description proceeds, especially when considered in conjunction with the accompanying drawings.

DETAILED DESCRIPTION

Figure 1:
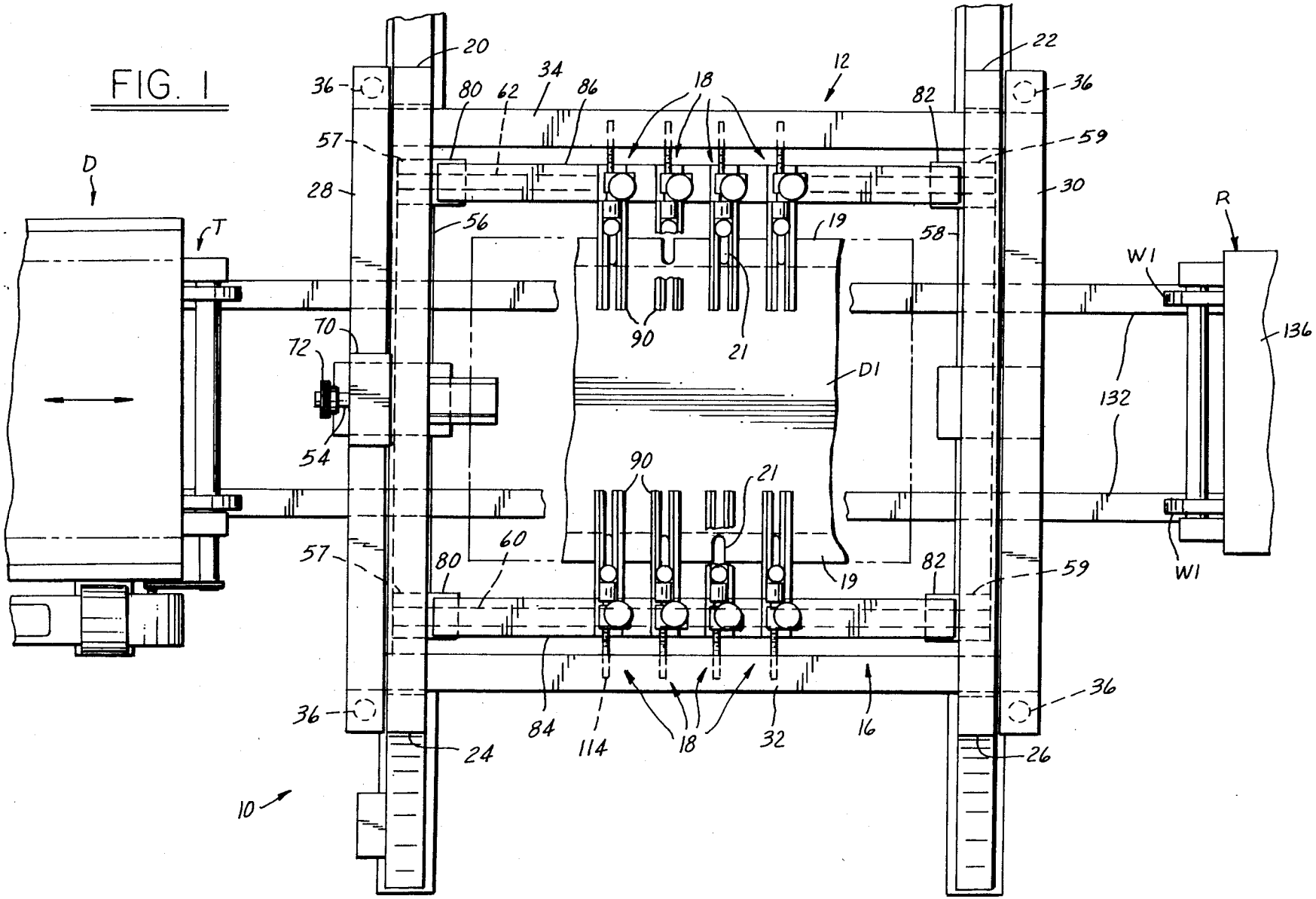
FIG. 1 is a fragmentary top plan view with parts broken away, of apparatus constructed in accordance with our invention.
Figure 2:
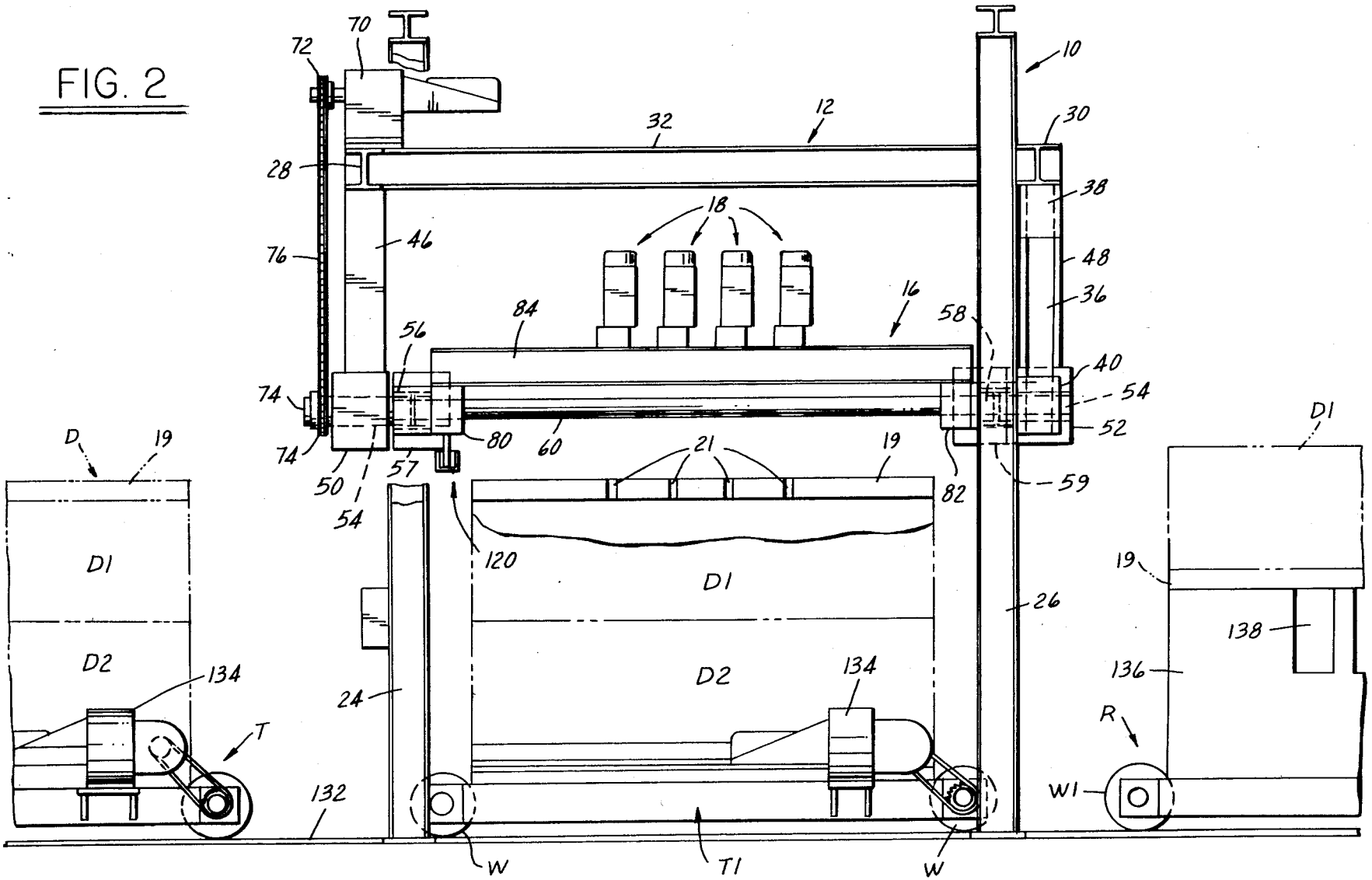
FIG. 2 is a front elevational view, with parts broken away, of the structure shown in FIG. 1.
Figure 3:
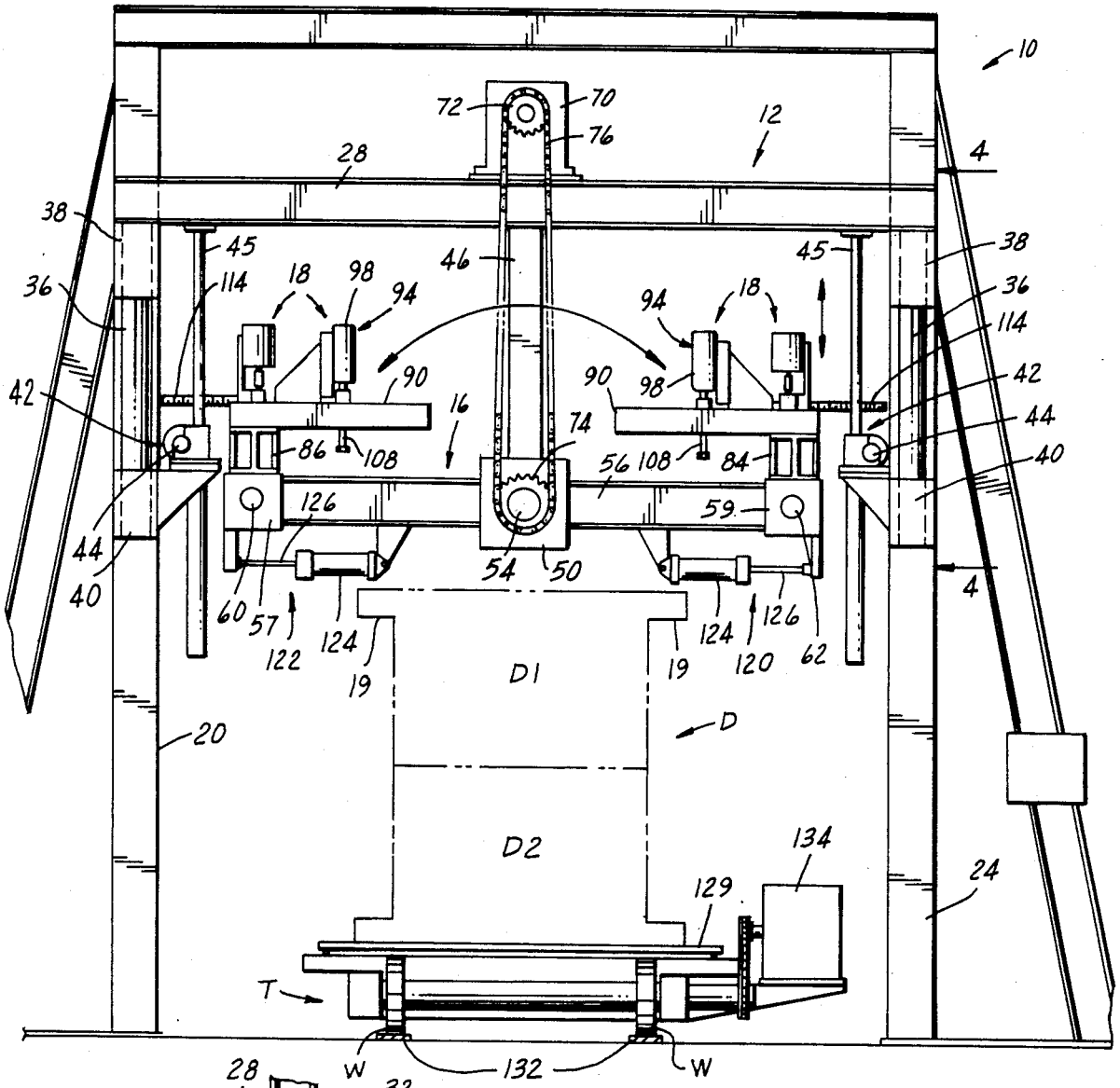
FIG. 3 is a side elevational view of the structure shown in FIGS. 1 and 2.
Figure 4:
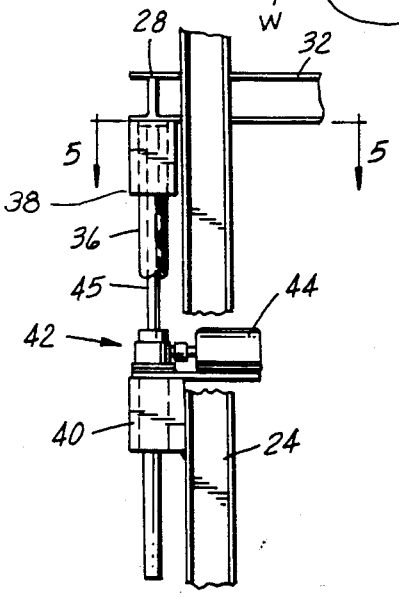
FIG. 4 is a fragmentary view, with parts broken away, taken on the line 4—4 in FIG. 3.
Figure 5:
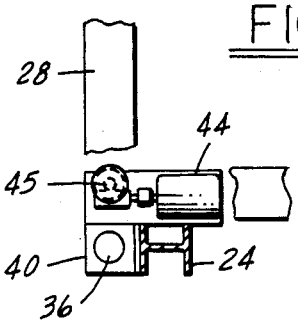
FIG. 5 is a fragmentary view, with parts broken away, taken on the line 5—5 in FIG. 4.
Figure 6:
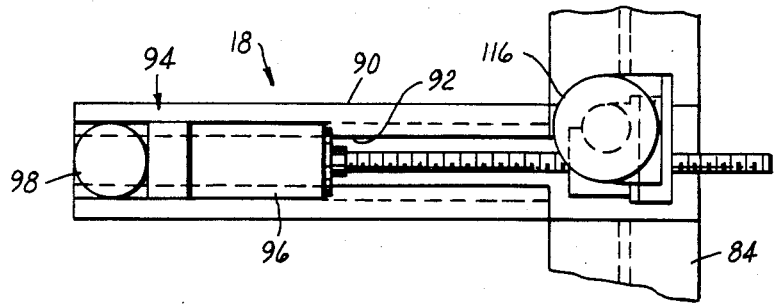
FIG. 6 is an enlarged top plan view of one of the clamping units which forms a part of the apparatus of this invention.
Figure 8:
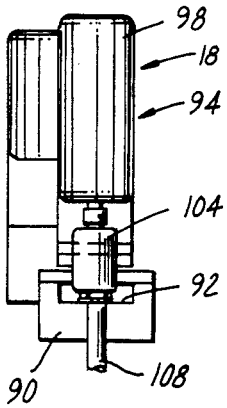
FIG. 8 is a view of the clamping unit looking towards the left in FIG. 7.

Referring now more particularly to the drawings and especially to FIGS. 1–3 thereof, the apparatus of this invention comprises a gantry having a fixed main frame 10, a fixture 12 mounted on the main frame for up and down reciprocation, a sub-frame 16 mounted on the fixture for 180° of rotation, and a plurality of clamping units 18 mounted on the sub-frame for clamping onto the upper die D-1 of a die set D consisting of the upper die D-1 and the lower die D-2. The apparatus also includes a transporter cart T for moving the die set to a transfer position under the fixture so that the upper die D-1 can be raised and inverted by the fixture, and a receiver cart R for moving the upper die D-1 away from the fixture after it has been inverted and returned to the transfer position. The upper die D-1 has a flange 19 projecting out from each side of the top surface, each flange having a plurality of equally spaced slots 21.

The fixed main frame comprises four vertical uprights 20, 22, 24 and 26 which are arranged at the corners of an imaginary rectangle.

The fixture 12 comprises a rectangular frame consisting of the spaced parallel side frame members 28 and 30 connected by the spaced parallel front and rear frame members 32 and 34. The fixture is guided for vertical reciprocation with respect to the main frame by vertical guide bars 36 secured to brackets 38 on the fixture and slidable in guide sleeves 40 mounted on the uprights of the main frame. The fixture 12 is raised and lowered by means of screw lifts 42 at the four corners of the fixture, each screw lift having a reversible motor 44 mounted on a bracket carried by one of the uprights of the main frame and operable to raise and lower a threaded rod or screw 45, the upper end of which is secured to one of the frame members 28, 30 of the fixture. Hence, operation of the motors 44 in one direction will raise the fixture and operation of the motors in the opposite direction will lower the fixture.

The sub-frame 16 is suspended from the fixture by a pair of vertical hangers 46 and 48 which have bearing blocks 50 and 52 at their lower ends. These bearing blocks 50 and 52 rotatably support aligned horizontal stub shafts 54 to the inner ends of which are secured the respective laterally spaced sub-frame members 56 and 58. The ends of the frame members 56 and 58 have mounting blocks 57 and 59 to which are connected the ends of spaced parallel front and rear shafts 60 and 62. The two parallel frame members 56 and 58 and the parallel shafts 60 and 62 cooperate to form an open rectangular sub-frame structure, which is larger in length and width than the upper die D-1 so that when the die set D is placed at the work transfer station beneath the sub-frame, the sub-frame can be lowered to a position in which the frame members 56, 58 and the shafts 60, 62 surround the upper die D-1.

The sub-frame 16 is rotated 180° in opposite directions about the axis of the aligned stub shafts 54 by means of a reversible motor 70 mounted on the fixture 12 which has a sprocket 72 on its output shaft. There is a sprocket 74 on one of the stub shafts 54 and a drive chain 76 which extends over the sprockets 72 and 74 transfers the rotation of the motor output shaft to the sub-frame 16 in one direction or the other depending on the direction of operation of the motor 70.

A pair of pivot blocks 80 and 82 are mounted for rotation on the shafts 60 and 62 in spaced apart relation. A frame member 84 is mounted on the blocks 80 and 82 of shaft, 60 and a frame member 86 is mounted on the blocks 80 and 82 of shaft 62. Each of the members 84 and 86 extends parallel to the shaft on which it is mounted. Along each of the frame members 84, 86 are provided a plurality of the spaced clamping units 18. The clamping units 18 on each of the frame members are spaced apart the same distance as the slots 21 in the flanges 19 along the upper edges of the top die D-1.

Each clamping unit 18 comprises a clamp arm 90 which in the operative clamping position shown in FIGS. 3, 7, 16–19 and 22, extends inwardly, that is towards the clamping units along the other frame member, at right angles to the frame member on which it is mounted. These clamp arms have channels 92 in their top surfaces extending lengthwise thereof, and a nut runner 94 is mounted on each clamp arm for longitudinal adjustment. Each nut runner has a slide 96 fitted into the channel of a clamp arm for longitudinal sliding movement, the slide supporting a reversible motor 98 in a position such that its output shaft 100 extends vertically downward. An adaptor 102 is secured to the lower end of the output shaft 100, and an elongated socket member 104 having a deep socket of hexagonal or other non-circular configuration is secured to the adaptor. The socket is open at the lower end and a nut 106 which is of the same hexagonal or other configuration as the socket, is fitted into the socket. A screw shaft 108 threads into the nut and has a head 110 at the lower end which in this instance is hex-shaped but may be of an other configuration so long as it has one or more flats on the side. The diameter of the shafts 108 is less than the width of the slots 21 in the flanges 19 on the upper die D-1 and the diameter of the heads 110 is greater. Hence, the nut runners 94 can be adjusted towards the end of the clamp arms so that the screw shafts 108 will enter the slots in the flanges 19 along the upper edge of a die D-1 at the work-transfer station and the flats on the heads 110 on the lower ends of the screw shafts will abut against the side of the die. Then when the motor 98 of a nut runner 94 is operated, the screw will move upwardly or downwardly in the nut depending on the direction of rotation of the motor. When the motor of a nut runner is operated to raise the screw shaft 108, the head 110 will move up into contact with the lower surface of the flange 19 and the flange will be clamped between the head of the screw shaft and the bottom surface of the clamp arm. The nut presses down upon a washer which encircles the screw shaft and bears upon the upper surface of the clamp arm.

The nut runner 94 is adjusted longitudinally with respect to the clamp arm by means of a worm gear actuator 112 through which a screw 114 from the slide 96 extends. The worm gear actuator 112 is operated in opposite directions by a motor 116 mounted on each clamp arm.

Figure 7:
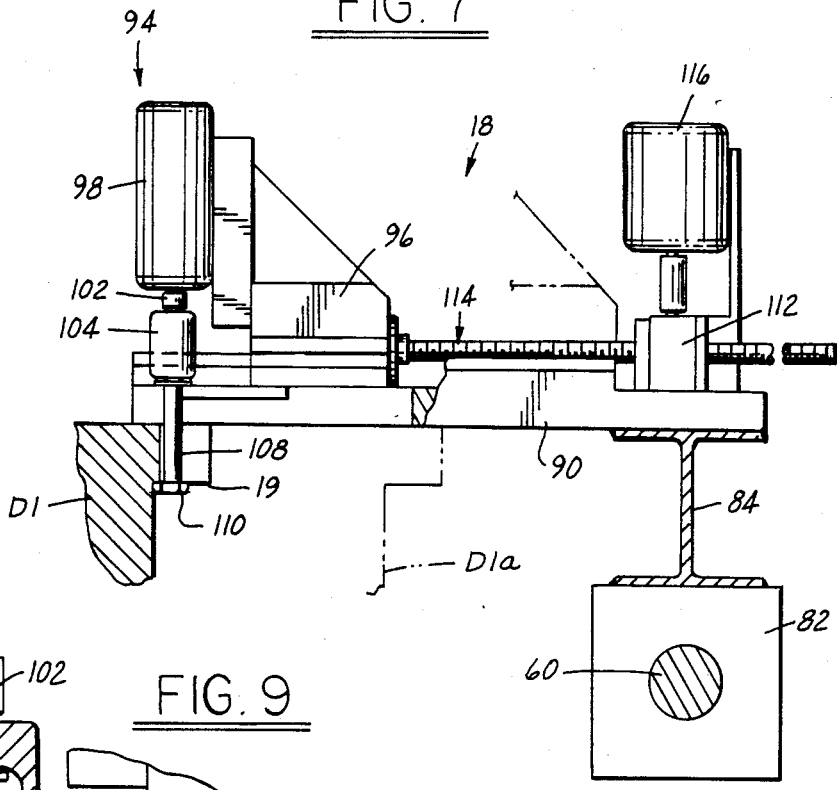
FIG. 7 is a side elevational view of the clamping unit shown in FIG. 6.
Figure 9:
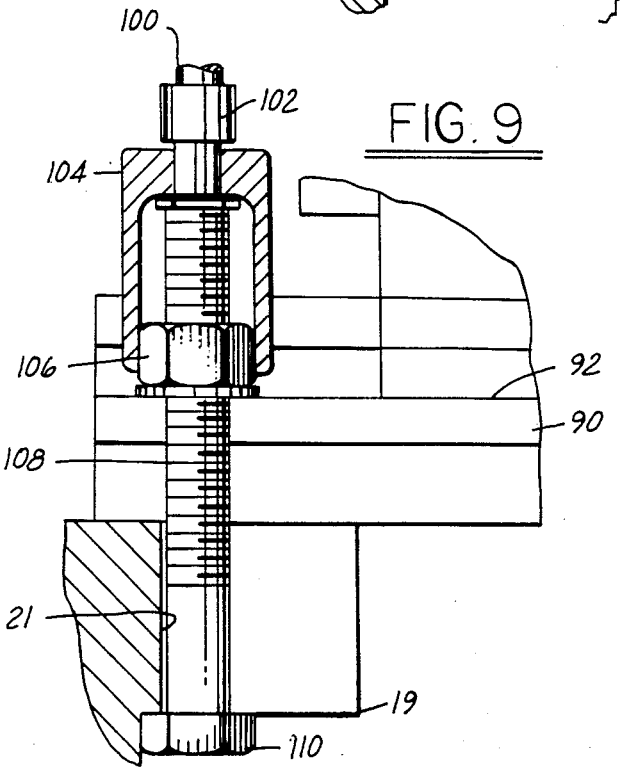
FIG. 9 is an enlarged fragmentary view, with parts in section, of a portion of FIG. 7.
Figure 10:
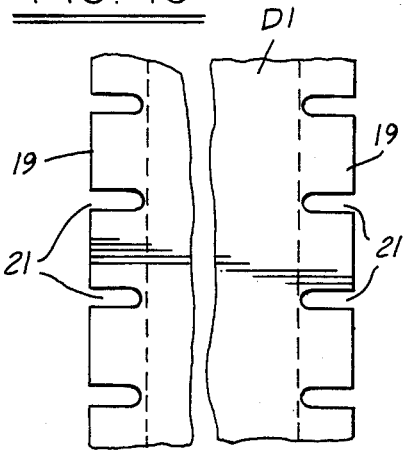
FIG. 10 is a fragmentary view, with parts broken away, showing the configuration of the top surface of an upper die.

The nut runner is capable of a rather substantial adjustment longitudinally of the clamp arm in order to accommodate dies of varying width. As shown in FIG. 7, some dies D-1 are of lesser width than other dies such as the one indicated by dot and dash lines at D-1*a*.

Figure 20:
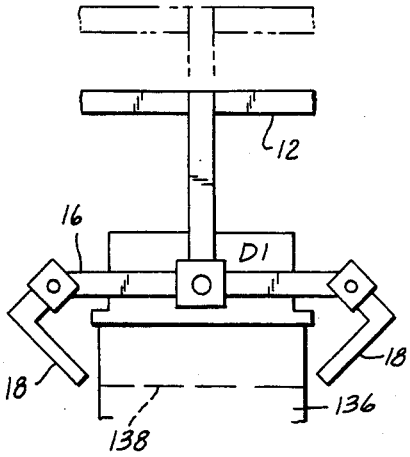
Figure 21:
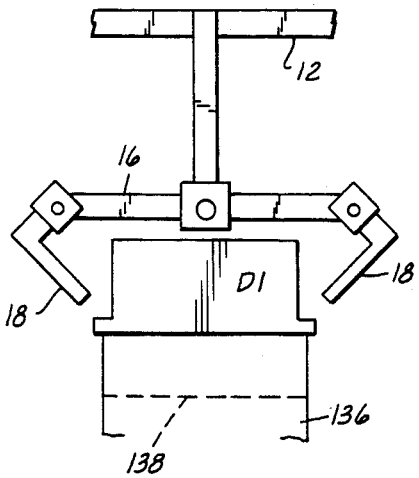
Figure 22:
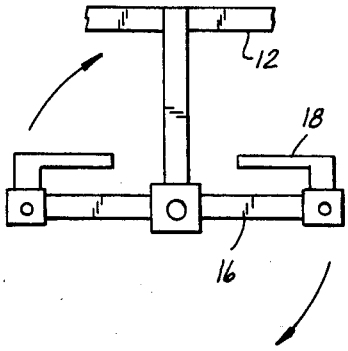

The clamping units are shown in their operative positions in FIGS. 3, 7, 16–19 and 22 in which the clamp arms 90 extend in a plane which is generally parallel to the plane of the fixture. However, since the clamp arms are mounted on frame members 84 and 86 carried by mounting blocks which are capable of rotation on shafts 60 and 62, the clamping units may be pivoted from this position to the retracted position of FIGS. 20 and 21 by piston-cylinder assemblies 120 and 122. One piston-cylinder assembly 120 is provided for the clamping units on frame member 84 and the other piston-cylinder assembly 122 is provided for the clamping units on frame member 86. Each piston-cylinder assembly has its cylinder 124 connected by a bracket to the fixture frame member 56 and its piston rod 126 connected by a bracket to one of the mounting blocks on shaft 60. The other piston-cylinder assembly has its cylinder 124 connected by a bracket to the fixture frame member 56 and its piston rod 126 connected by a bracket to one of the mounting blocks on shaft 62. Operation of these piston-cylinder assemblies by the admission of pressure fluid to the rod ends of the cylinders causes the clamp units to pivot from the position of FIG. 3 to the retracted position as shown in FIGS. 20 and 21. Pressure fluid to the head ends of the cylinders causes the clamping units to be pivoted back to the FIG. 3 position.

Figure 11:
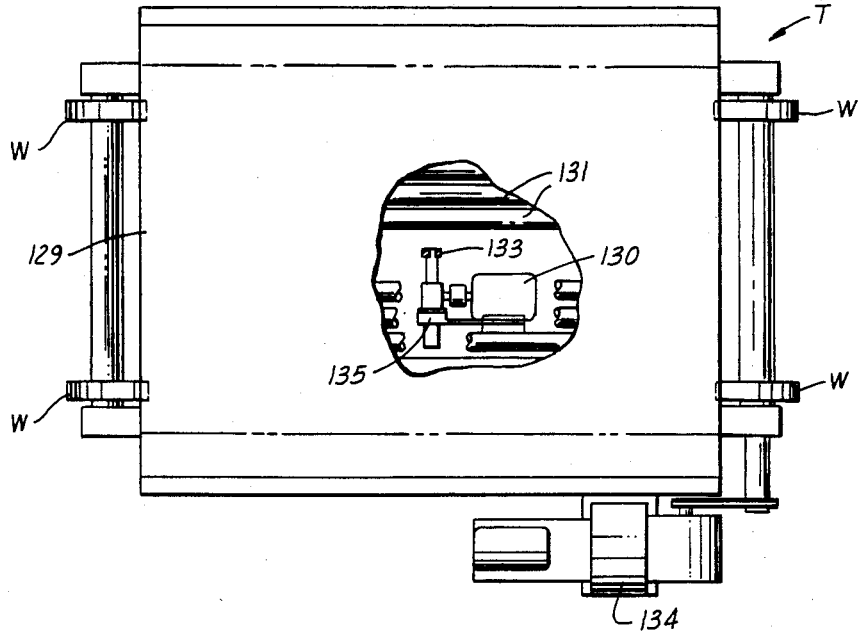
FIG. 11 is a top plan view, with parts broken away, showing the transporter cart.
Figure 12:
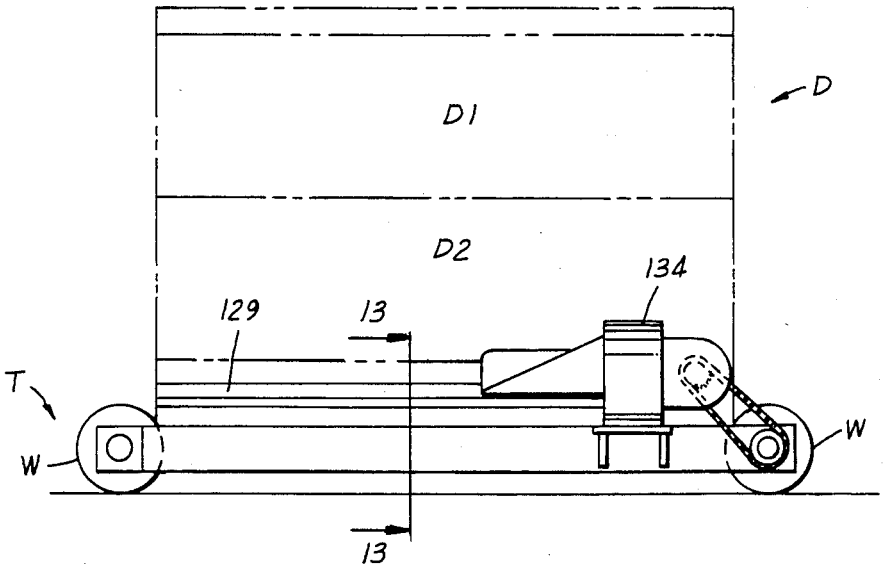
FIG. 12 is a side elevational view of the cart shown in FIG. 11.
Figure 13:
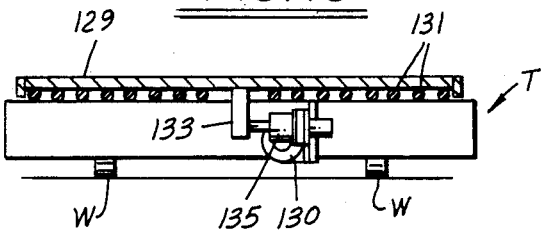
FIG. 13 is a fragmentary sectional view taken on the line 13—13 in FIG. 12.
Figure 14:
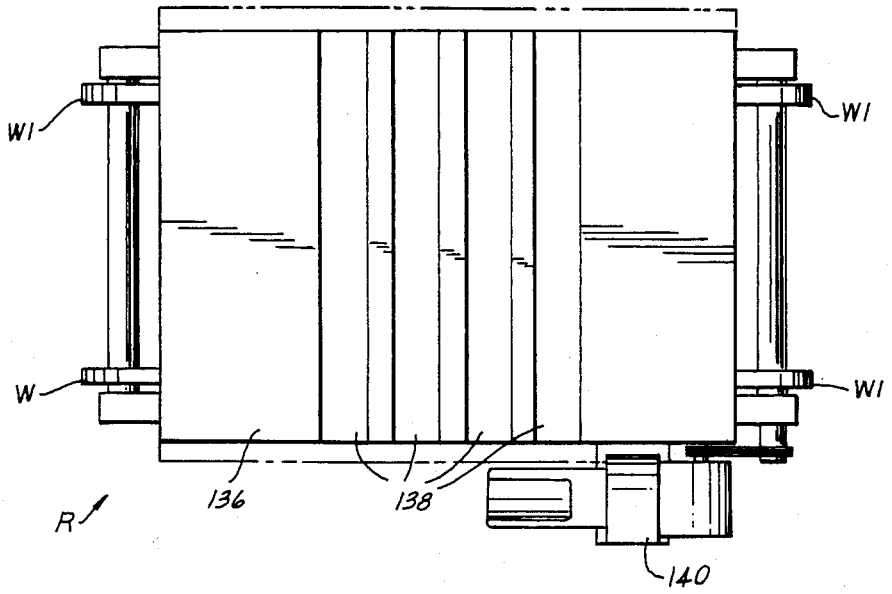
FIG. 14 is a top plan view of the receiver cart.
Figure 15:
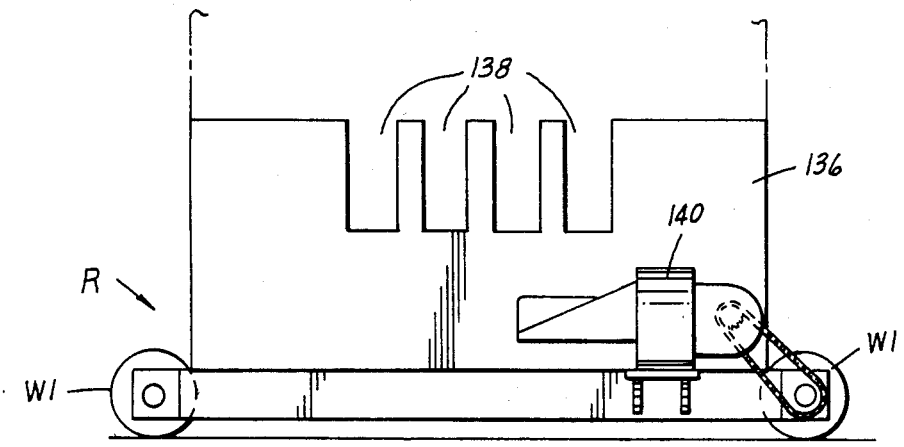
FIG. 15 is a side elevational view of the receiver cart shown in FIG. 14.
Figure 16:
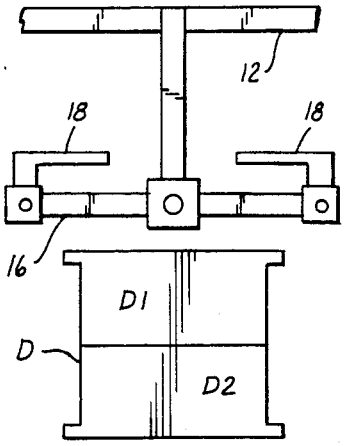
FIGS. 16–22 are schematic views showing the manipulator apparatus in several stages as it carries out the steps of elevating, inverting and lowering an inverted die onto the receiver cart.

Referring to FIGS. 11 to 13, the transporter cart T has a sub-frame or chassis supported on wheels W. A table 129 is supported on the chassis by a plurality of longitudinally extending rollers 131 for adjustment laterally with respect to the direction in which the cart moves. The rollers are mounted on the chassis for free axial rotation by means not shown. The table is adjusted laterally by a reversible motor 130 carried by the chassis which is connected to a depending bracket 133 of the table 129 through a gear box 135 so that operation of the motor in one direction will shift the table laterally in one direction and reverse operation of the motor will shift the table in the opposite direction. The table is provided to support the die set D thereon, and lateral adjustment of the table is desirable in order to properly align the top die D-1 with the clamping units. It will be noted that the transporter cart T moves under the fixture of the manipulator apparatus on tracks 132 which extend from one side to the other of the manipulator. Thus the die set may be moved by the transporter cart T from the position at the left in FIG. 2 to a transfer position under the fixture as also shown at T-1 in FIG. 2, where the upper die may be lifted away and inverted by the fixture. The transport cart is driven by a reversible motor 134 mounted on the chassis having a chain drive to one of the wheels.

The receiver cart R also runs on the tracks by its wheels W-1 and has a support 136 on which to receive an inverted upper die D-1. The top surface of the support 136 is generally horizontal, but is cut out or recessed so as to provide transfer slos 138 extending from side to side, equal in number and spacing to the clamp arms of the several clamping units. These slots provide clearance for the clamp arms when they deposit an inverted die D-1 on the support 136 of the receiver cart and also when the clamp arms are pivoted away to the retracted positions of FIGS. 20 and 21 to release the upper die. The receiver cart is driven by a reversible motor 140 having a chain drive to one of the wheels W-1.

As previously stated, it is often necessary to carry out repair and maintenance procedures on the dies D-1 and D-2. Such procedures are performed on the adjacent contoured faces of the dies. There is no problem with the lower die because it faces upwardly. However, the die face of the upper die D-1 faces downwardly and cannot conveniently be worked upon. Therefore, the upper die D-1 is inverted by the apparatus of this invention in accordance with the procedures described below.

With the fixture 12 raised and the sub-frame 16 in the position of FIGS. 1 to 3 and 16, a cart T with the die set D upon its table 129 is moved by its motor 134 on tracks 132 from the left in FIG. 2 to the work transfer position T-1 beneath the fixture. Prior to operation of the motor 134 to advance the cart T to the work transfer position, the motor 130 is operated to initially adjust the table of the cart transversely and thereby properly align the die set.

Figure 17:
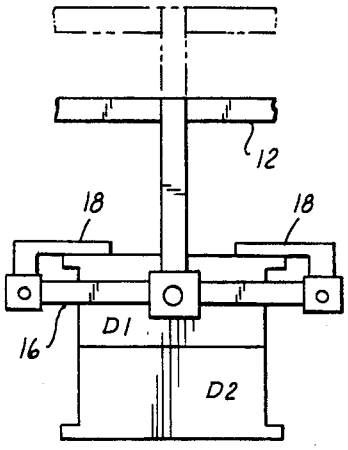

The fixture is lowered to its FIG. 17 position in which the fixture surrounds the upper die and clamp arms 90 rest lightly on die flanges 19. The table 129 may be further adjusted laterally by operation of motor 130 and longitudinally by operation of motor 134 to center die set D so that the slots 21 along the flanges 19 of the upper die D-1 are positioned properly with the shafts 108 of the clamping units 18 directly laterally outwardly of the slots. Thereafter, the motors 116 of the clamping units are operated to extend the nut runners 94 and cause the shafts 108 to enter the slots 21 in the flanges 19 and the flats on the shaft heads 110 to abut the side of upper die D-1. Then the nut runner motors 98 are operated to retract the shafts 108 and clamp the flanges 19 between the heads 110 and the clamp arms 90.

Figure 18:
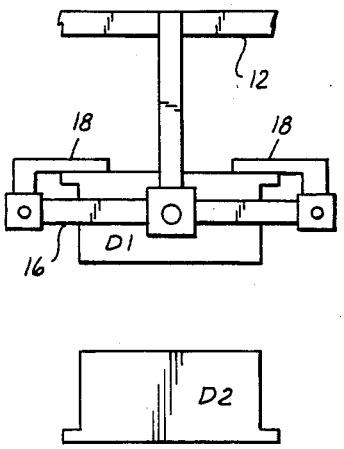
Figure 19:
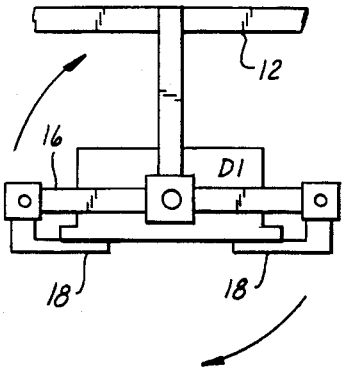

After all of the clamping units 18 are firmly clamped onto the flanges 19 of the upper die, the fixture 12 is raised by operation of the motors 44 to elevate the sub-frame 16 to the FIG. 18 position. Then cart T is withdrawn to the left in FIG. 2, and the motor 70 is operated to invert the sub-frame 16 and hence the upper die as in FIG. 19. The receiver cart R is then moved to the transfer position such that its slots 138 are directly beneath the clamp arms 90 of the several clamping units. The motors 44 are again operated to lower the sub-frame 16 to deposit the inverted die on the supporting surface of the receiver cart as in FIG. 20, after which the clamping units are unclamped by operation of nut runners 94 and the screw shafts 108 withdrawn from slots 21 by operation of motors 116, whereupon the clamp arms are retracted by piston-cylinder assemblies 120 and 122. The fixture is again elevated to the position of FIG. 21 above the inverted die, after which the receiver cart is moved away from the transfer position to a position in which the desired maintenance or repair procedures on the upper die D-1 may be carried out. The sub-frame 16 may then be reverse rotated to its initial position and the clamp arms returned to their normal positions shown in FIG. 16 in readiness for a repeat of the procedural steps thus described. Obviously, by carrying out the steps in the reverse sequence the die D-1 after it has been repaired may be returned to the work transfer station, turned back to its original upright position by the manipulator mechanism and placed back on the die D-2 of the die set and carried away by the transporter cart.

FIGS. 23–32 show a modification of the invention in which the gantry, including fixture 12 and related components for reciprocating the fixture up and down on the main frame 10, is essentially the same as that previously described in connection with the embodiment of FIGS. 1–22 and, therefore, corresponding parts have been given the same reference numerals. The essential differences in the gantry of FIGS. 23–32 from the corresponding gantry previously described are in the sub-frame 16′ and related components.

The sub-frame 16′ is suspended from the fixture 12 by a pair of bearing blocks 200 and 202. These bearing blocks 200 and 202 rotatably support aligned horizontal stub-shafts 204 and 206, to the inner ends of which are secured the respective laterally spaced parallel sub-frame members 208 and 210. The ends of the sub-frame members 208 and 210 are connected by the spaced parallel front and rear sub-frame members 212 and 214. The four sub-frame members 208, 210, 212 and 214 cooperate to form an open rectangular sub-frame structure which is larger in length and width than the upper die D-1 so that when the die set D is placed at the work transfer station beneath sub-frame 16′, the sub-frame can be lowered from the FIG. 24 position to a position in which the sub-frame members 208–214 surround the upper die D-1.

The sub-frame 16′ is capable of being rotated 108° in opposite directions about the axis of the aligned stub-shafts 204 and 206 by a drive which is functionally the same as the drive described in connection with the embodiment of FIGS. 1–22. The drive comprises a reversible motor 216 which is mounted on the fixture 12 and has a sprocket 218 on its output shaft. There is also a sprocket 220 on the stub-shaft 204. A drive chain 222 extends over the sprockets 218 and 220 to transfer the rotation of the motor output shaft to the sub-frame 16' in one direction or the other depending upon the direction of operation of the motor 216.

Mounted on the sub-frame members 212 and 214 are a pair of open ended tubular members 224 and 226 of rectangular cross-section, each having a longitudinal slot 225 along the full length of its top wall. Clamp bars 228, 230, 232, and 234 extend between the tubular members with their ends supported thereon. The clamp bars are open ended tubular members of rectangular cross-section and each has a longitudinal slot 236 in the bottom wall along the full length thereof. Nut and bolt assemblies 238 connect the clamp bars to the tubular members. Each nut and bolt assembly 238 comprises a bolt 240 the head of which is disposed within one of the tubular members 224 and 226 and the shank of which extends upwardly through the slot 225, through the slot 236 in one of the clamp bars and through a hole in the top wall of the clamp bar. A nut 241 is threaded on the upper end of the bolt. The clamp bars may be slid along the length of the tubular members 224 and 226 and then secured in adjusted positions by means of these nut and bolt assemblies.

Two nut and bolt assemblies 242 are carried by each of the clamp bars 228–234. Each nut and bolt assembly 242 has a bolt 244 the head of which is disposed inside the tubular clamp bar and the shank of which extends down through the slot 236 of the clamp bar. A nut 245 is threaded on the bolt. By sliding the clamp bar along sub-frame members 212 and 214 to align them with the slots 21 in the flanges of the die D-1, and sliding the nut and bolt assemblies 242 along the clamp bars to extend them into these slots and then tightening the nuts, the upper die D-1 can be clamped to the clamp bars.

Figure 23:
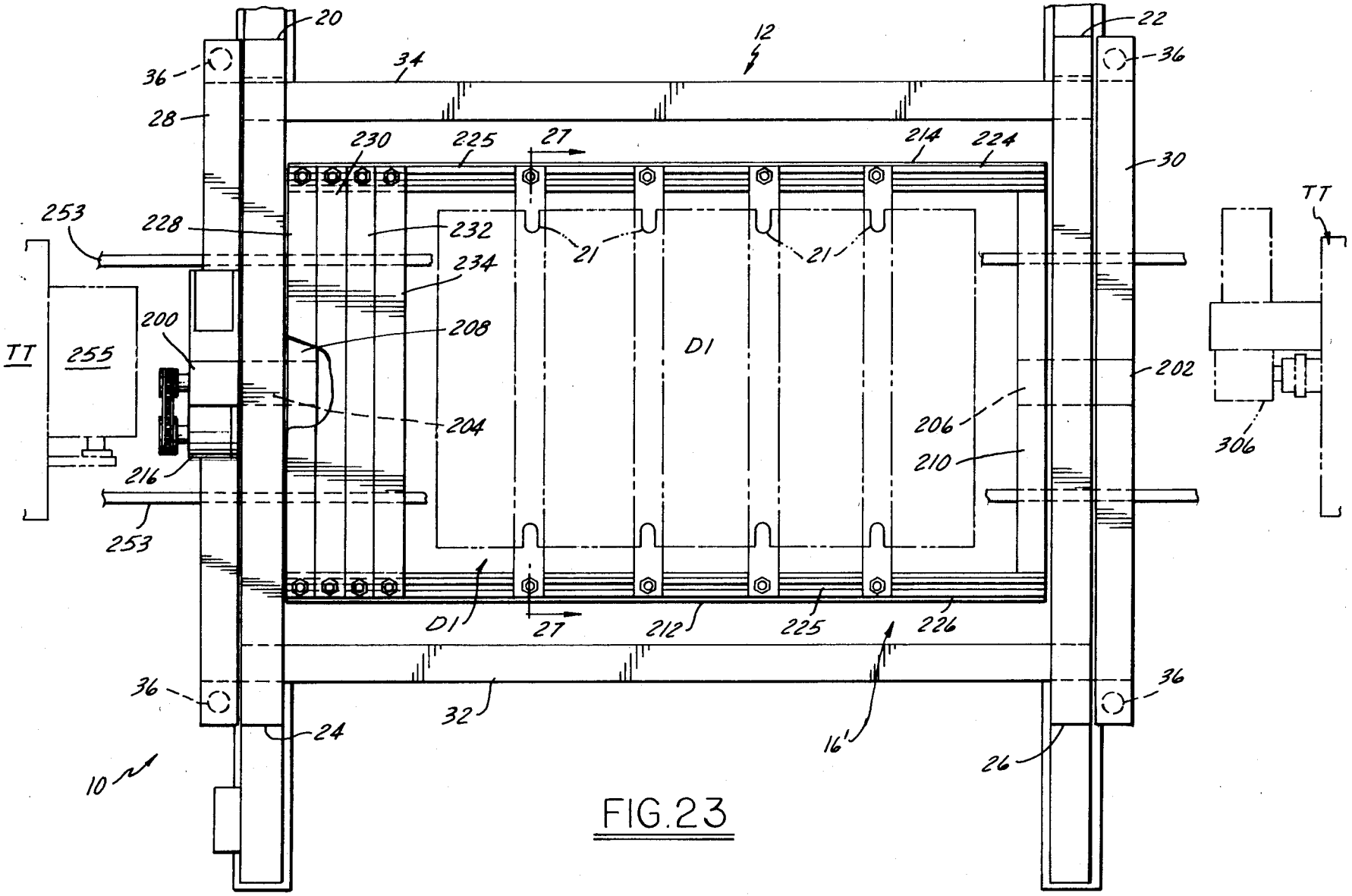
FIG. 23 is a top plan view similar to FIG. 1 showing apparatus of a modified construction.

FIG. 23 shows the clamp bars stacked at one end of the sub-frame 16' leaving an open area through which the die set may be placed on a cart at the work-transfer station by an overhead crane operating through the open top of the gantry.

The transporter cart TT has a chassis 250 supported on wheels 252 and is driven on tracks 253 by motor 255. The cart has a table 254 for supporting a die set.

The table 254 comprises parallel longitudinal frame members 256 which support parallel transverse tubular frame members 258. The transverse frame members are permanently mounted on the longitudinal frame members. Permanently secured to each of the transverse frame members is a tubular open ended bar 260 having a longitudinal slot 262 along the full length of its top surface. The top surfaces of the bars 260 are flush with the top surfaces of the transverse frame members 258 and lie in a common plane.

The transverse frame members 258 support laterally spaced, longitudinally extending parallel tubular frame members 264 and 265. The two inner longitudinal frame members 264 are permanently affixed to the transverse frame members and the two outer longitudinal frame members 265 are mounted thereon for laterally in and out sliding movement. Secured to the top surface of the outer longitudinal frame members 265 are longitudinally extending clamp bars 266. These clamp bars are open ended tubular members and each has a longitudinal slot 268 along the full length of its top surface.

Figure 32:
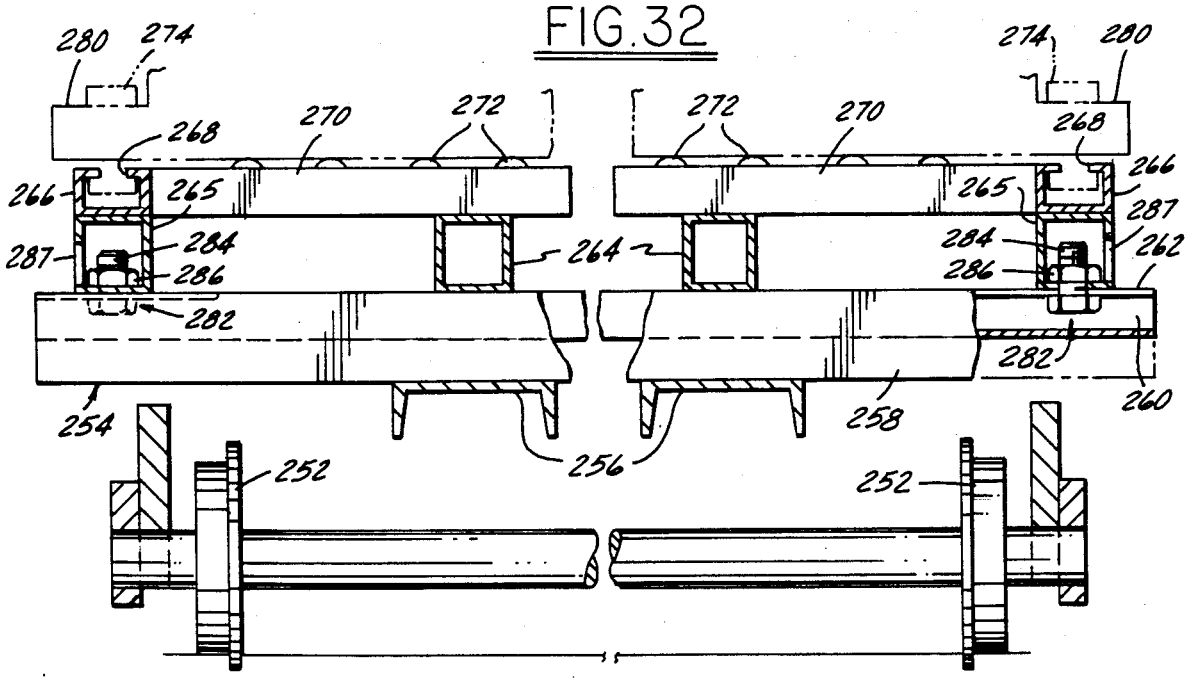
FIG. 32 is a sectional view taken on the line 32—32 of FIG. 28.
Figure 28:
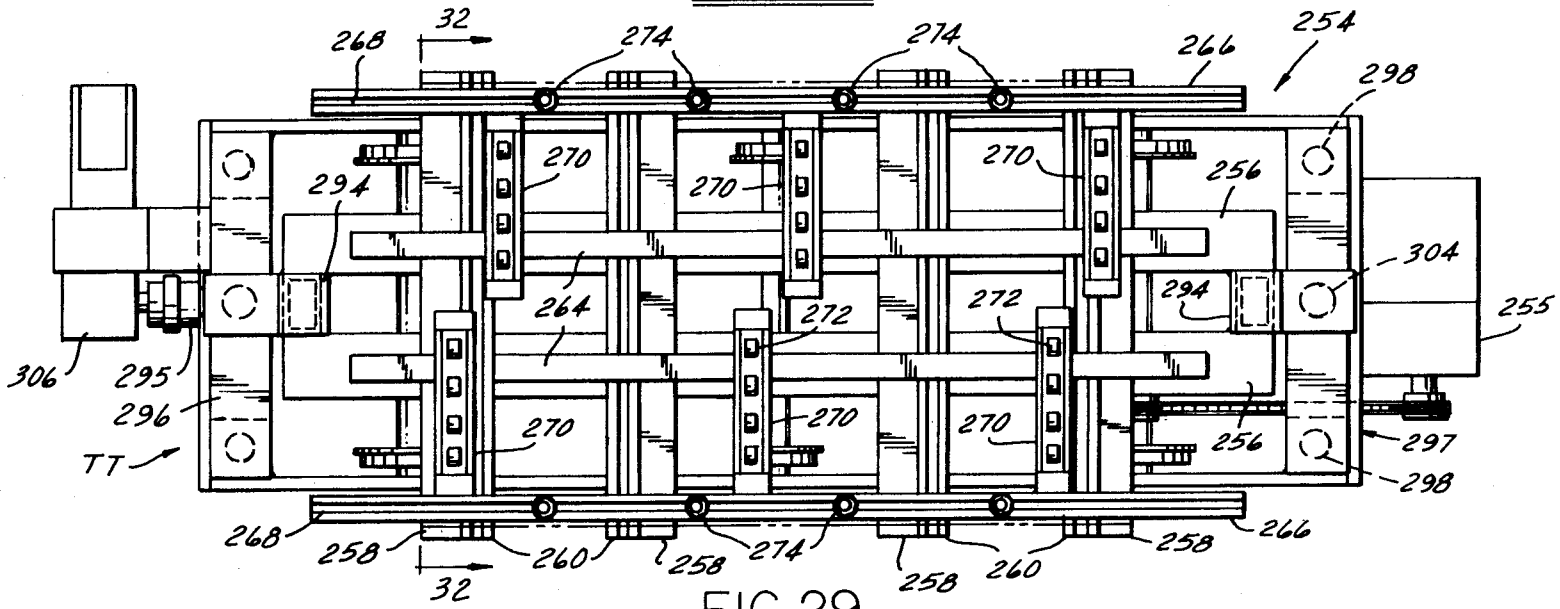
FIG. 28 is a top plan view of a transporter cart of modified construction for use with apparatus shown in FIGS. 23–27.
Figure 29:
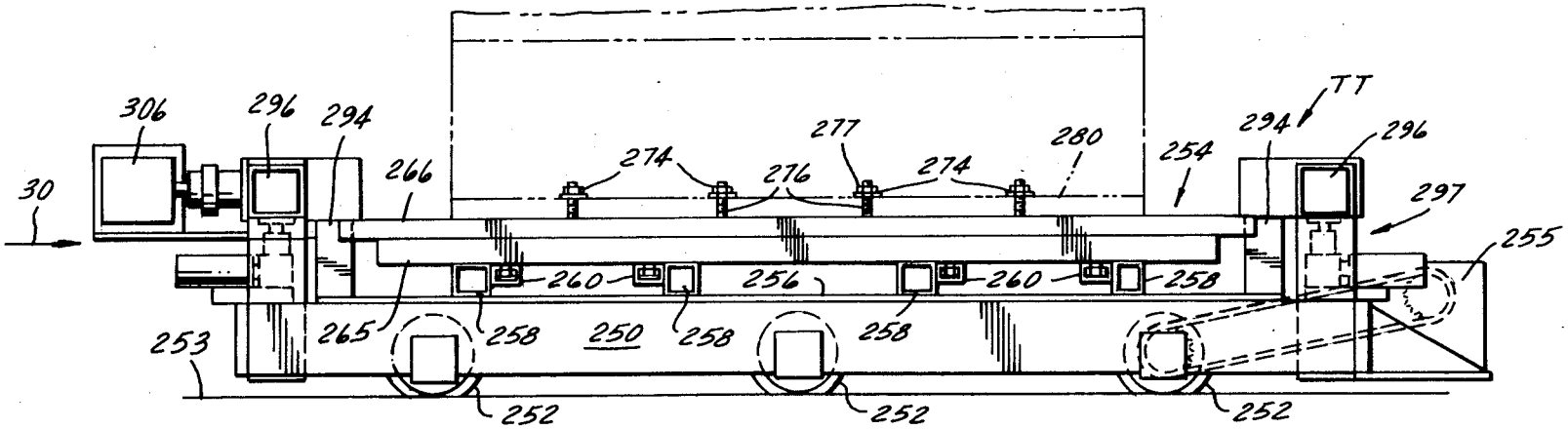
FIG. 29 is a side elevational view of the cart shown in FIG. 28.

Support bars 270 are secured to and extend inwardly from the clamp bars 266 and their inner ends are supported on the two inner longitudinal frame members 264. These support bars have rollers 272 on the top surface serving as anti-friction members. The lower die of a die set is adapted to be supported on these rollers which are in common plane slightly above the clamp bars 266, as shown in FIG. 32. These rollers 272 have their axes extending longitudinally of the table and facilitate loading of the die set from the side. The rollers may be mounted on the support bars by means permitting them to be lowered so that after loading the weight of the die set may be transfered to the clamp bars.

Nut and bolt assembles 274 are provided for each of the clamp bars 266, each having a bolt 276 provided with a head located inside the clamp bar and a shank extending through the slot 268 in the clamp bar. Nuts 277 thread onto the shanks. These nut and bolt assemblies are for clamping to the lower D-2 by entering the slots 278 in the flanges 280 along both sides thereof.

Nut and bolt assemblies 282 are provided to secure the clamp bars 266 in proper laterally spaced relation for clamping to the lower die. Each assembly 282 has a bolt 284 the head of which is inside one of the transverse bars 260 and the shank of which extends up through the slot 262 in the top wall thereof and through a hole in the bottom of one of the outer longitudinally extending frame members 265. Nuts 286 inside frame members 265 thread onto the bolt shanks. Nuts 286 are accessible for tightening by way of holes 287.

The ends of the longitudinal frame members 256 of the table are rigidly secured to the supporting members 294 located at the ends of the cart. These supporting members are mounted on aligned longitudinally extending stub-shafts 295 carried by transverse lifting bars 296 of lifting mechanism 297. Lifting bars 296 are moved vertically to raise and lower the table and are guided in such vertical movement by guide rods 298 which extend downwardly from the opposite ends of the lifting bars and are supported for vertical sliding movement in the guide rod supports 300. Motors 302 at the ends of the cart operate ball screw jacks 304 to raise and lower the lifting bars.

The table is rotatable from the horizontal position shown to an angle on the order of about 90° by means of the motor drive 306 connected to the stub-shaft 295 at one end of the table.

Manipulation of the die D-1 by the apparatus of FIGS. 23–32 in preparation for repair and maintenance procedures is similar to that described in connection with the previous embodiment. The die set D may be loaded on the table 254 of the cart TT with the cart in a position to one side of the work-transfer station beneath the gantry. Alternatively, loading the die D onto the table of the cart TT may be carried out with the cart at the work-transfer station by first stacking the clamp bars 228–234 at one end of the sub-frame 16' as in FIG. 23 to leave an open area through which the die set may be placed on the cart by an overhead crane operating through the open top of the gantry. With the lower die D-2 resting upon the rollers 272 on support bars 270 of the table and the table horizontal, the nut and bolt assemblies 274 carried by clamp bars 266 are moved into alignment with the slots 278 in the flanges 280 along the sides of the lower die. Then the clamp bars 266 are moved laterally inwardly until the nut and bolt assemblies 274 enter the slots 278 after which the nut and bolt assemblies 282 are tightened to lock the clamp bars 266 in proper laterally spaced relation and nut and bolt assemblies 274 are tightened to clamp the flanges 280 of the lower die to the clamp bars.

Figure 24:
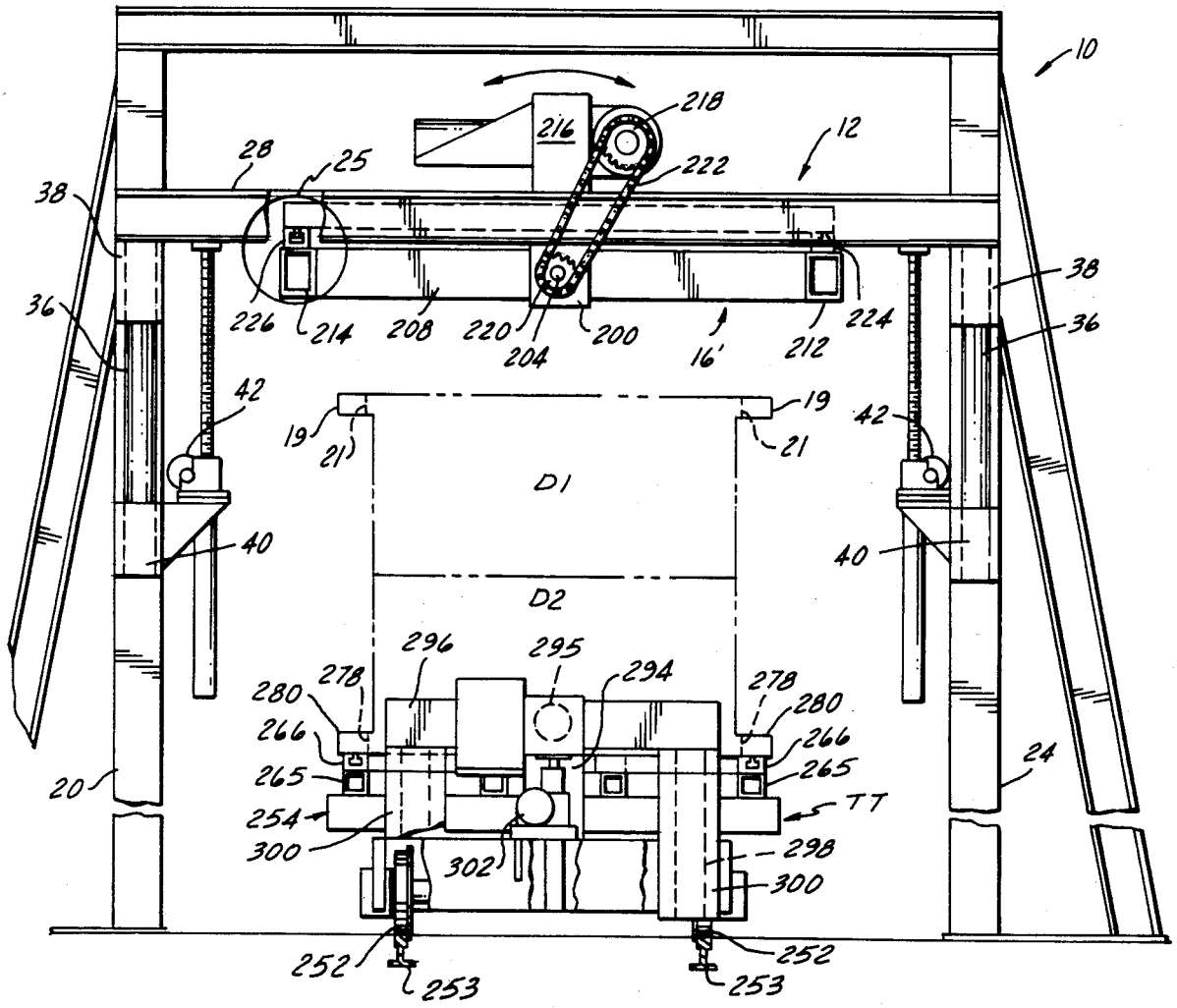
FIG. 24 is a side elevational view of the structure shown in FIG. 23.
Figure 25:
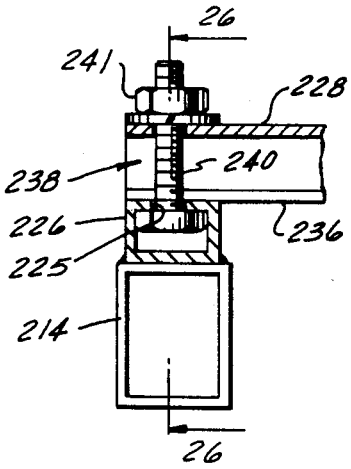
FIG. 25 is an enlarged fragmentary sectional view of that portion of FIG. 24 within the circle 25.
Figure 26:
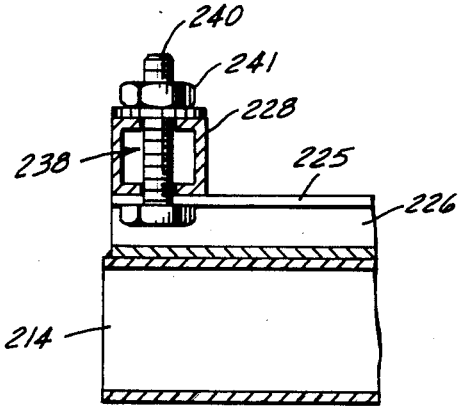
FIG. 26 is a sectional view taken on the line 26—26 of FIG. 25.
Figure 27:
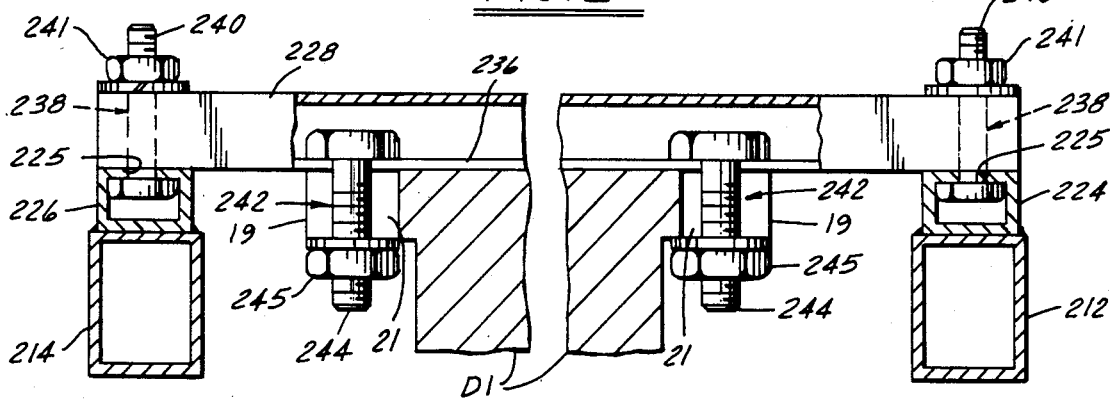
FIG. 27 is a sectional view taken on the line 27—27 of FIG. 23.
Figure 31:
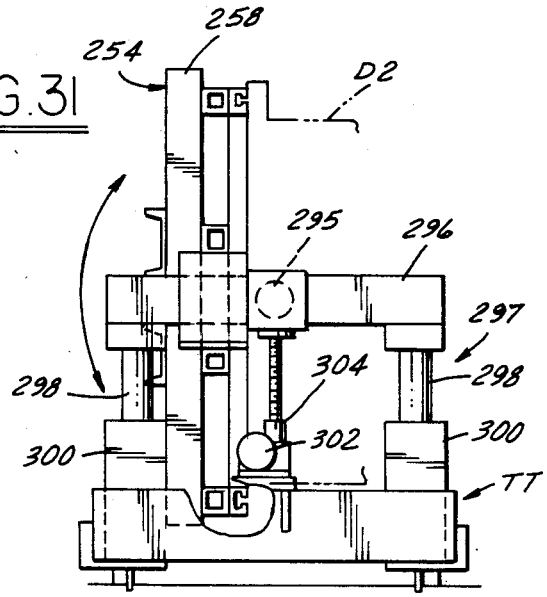
FIG. 31 is a view similar to FIG. 30 but with the table of the cart in an elevated and tilted position.
Figure 30:
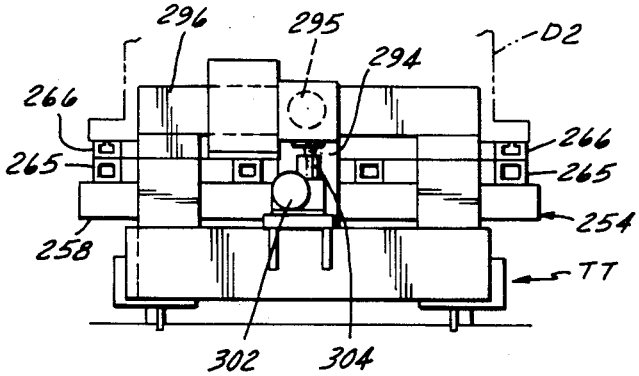
FIG. 30 is an end elevational view of the cart looking in the direction of the arrow 30 in FIG. 29.

With the die set clamped to the table and the cart at the work-transfer station, the fixture 12 is lower from the FIG. 24 position to a position in which the clamp bars 228–234 are spaced just slightly above the top surface of the upper die D-1. The clamp bars are shifted along the tubular members 224 and 226 to positions overlying the slots 21 along the flanges 19 of the upper die D-1. Thereafter the nut and bolt assemblies 242 are slid along the clamp bars until they move into the slots 21. The nut and bolt assemblies 242 are tightened to clamp the upper die D-1 to the clamp bars, and the nut and bolt assemblies 238 are tightened to secure the clamp bars in their adjusted positions. Thereafter, the fixture 12 and sub-frame 16' are raised, the upper die D-1 being raised along with the sub-frame 16', and the cart carrying only the lower die D-2 is moved along the tracks 253 away from the work-transfer station.

The upper die D-1 carried by the sub-frame 16' may be inverted and lowered onto a receiver cart in inverted position and carried away for repair and maintenance in the same manner as described above in connection with the previous embodiment. Alternately, the sub-frame may be turned less than 180°, for example, 90° and lowered to enable the upper die D-1 to be inspected and/or cleaned, as desired. Minor repair and maintenance procedures may also be carried out on the upper die D-1 in this tilted position while still attached to the sub-frame 16', if desired.

With the cart TT removed from the work-transfer station, the cart table may be elevated by operation of motors 302 to raise the lifting mechanism 297, permitting the table to be rotated by the motor 306 to an angle of about 90° so that the lower die D-2 may be conveniently inspected and cleaned. Minor repairs may be carried out on the lower die D-2 in this position, although in most cases repair and maintenance will be performed when the lower die is in a more nearly horizontal position. However, as stated, the tilted position of about 90° is often preferred for inspecting and cleaning.

We claim:

1. Apparatus for manipulating the upper and lower dies of a die set for maintenance procedures, comprising means providing a work-transfer station, a main frame adjacent said work-transfer station, a fixture, means mounting said fixture on said main frame for up and down movement away from and toward said work-transfer station, a sub-frame, means mounting said sub-frame on said fixture for rotation about a horizontal axis, clamping means on said sub-frame to clamp the upper die of a die set at said work-transfer station when said fixture is in a lower position, means for raising said fixture to pick up and elevate said upper die to an upper position and for rotating said sub-frame to turn said upper die, a cart for supporting and advancing the die set to said work-transfer station for pick up of the upper die and for withdrawal of the lower die after pick up of the upper die, and means for lowering said fixture back to said lower position to return said upper die to said work-transfer station in turned position, said sub-frame having a pair of laterally spaced frame members, said clamping means comprising a plurality of clamp bars extending between said frame members and connected thereto for sliding movement lengthwise thereof, means for securing said clamp bars to said frame members in adjusted positions along the length thereof, and clamping elements on said clamp bars for engaging and clamping the upper die.

2. Apparatus as defined in claim 1, wherein said clamping elements are carried by said clamp bars in adjusted positions lengthwise thereof.

3. Apparatus as defined in claim 2, wherein said frame members are channel-shaped and said clamp bars are channel-shaped, said clamp bars are connected to said frame members by nut and bolt assemblies slidably received in the channels of said frame members, and said clamping elements are nut and bolt assemblies slidably received in the channels of said clamp bars.

4. Apparatus for manipulating the upper and lower dies of a die set for maintenance procedures, comprising means providing a work-transfer station, a main frame adjacent said work-transfer station, a fixture, means mounting said fixture on said main frame for up and down movement away from and toward said work-transfer station, a sub-frame, means mounting said sub-frame on said fixture for rotation about a horizontal axis, clamping means on said sub-frame to clamp the upper die of a die set at said work-transfer station when said fixture is in a lower position, means for raising said fixture to pick up and elevate said upper die to an upper position and for rotating said sub-frame to turn said upper die, a cart for supporting and advancing the die set to said work-transfer station for pick up of the upper die and for withdrawal of the lower die after pick up of the upper die, and means for lowering said fixture back to said lower position to return said upper die to said work-transfer station in turned position, a table mounted on said cart for rotation about a horizontal axis and adapted to support said die set thereon with the upper die resting on the lower die, clamping means on said table for clamping the lower die thereto, and means operative after raising of said fixture and moving of said cart away from said work-transfer station for rotating said table about said horizontal axis to turn the lower die clamped thereto.

5. Apparatus as defined in claim 4, wherein said cart has a sub-frame, and means mounting said table on said sub-frame of said cart and for raising and lowering said table relative thereto, said table being rotated as aforesaid in the raised position of said table.

6. Apparatus as defined in claim 5, wherein said clamping means on said table comprises a pair of clamp bars, means for mounting said clamp bars on said table in adjusted laterally spaced relationship, and clamping elements on said clamp bars for engaging and clamping the lower die.

7. Apparatus as define in claim 6, wherein said means for mounting said clamp bars on said table comprise frame members extending transversely of said clamp bars, said frame members and said clamp bars being channel-shaped, said clamp bars being connected to said frame members by nut and bolt assemblies slidably received in the channels of said frame members, and said clamping elements comprising nut and bolt assemblies slidably received in the channels of said clamp bars.

8. Apparatus as defined in claim 7, wherein said first-mentioned sub-frame has a pair of laterally spaced second frame members, said clamping means on said first-mentioned sub-frame comprising a plurality of second clamp bars extending between said second frame members and connected thereto for sliding movement lengthwise thereof, means for securing said second clamp bars to said second frame members in adjusted positions along the length thereof, and second clamping elements on said second clamp bars for engaging and clamping the upper die.

9. Apparatus as defined in claim 8, wherein said second clamping elements are carried by said second clamp bars in adjusted positions lengthwise thereof.

10. Apparatus as defined in claim 9, wherein said second frame members are channel-shaped and said second clamp bars are channel-shaped, said second clamp bars are connected to said second frame members by nut and bolt assemblies slidably received in the channels of said second frame members, and said second clamping elements are nut and bolt assemblies slidably received in the channels of said second clamp bars.

11. A cart for transporting a die set consisting of upper and lower dies to a work-transfer station where the upper die may be removed, a table mounted on said cart for rotation about a horizontal axis and adapted to support said die set thereon with the upper die resting on the lower die in a manner such that the upper die can be removed at said work-transfer station, means on said table for clamping the lower die thereto, and means connected to said table for rotating said table about said horizontal axis after the upper die has been removed to turn the lower die to a position suitable for inspection and cleaning.

12. A cart as defined in claim 11, wherein said cart has a sub-frame, and means mounting said table on said sub-frame and for raising and lowering said table relative to said sub-frame, said table being rotated as aforesaid in the raised position of said table.

13. A cart as defined in claim 12, wherein said clamping means comprises a pair of clamp bars, means for mounting said clamp bars on said table in adjusted laterally spaced relationship, and clamping elements on said clamp bars for engaging and clamping the lower die.

14. A cart as defined in claim 13, wherein said means for mounting said clamp bars on said table comprise frame members extending transversely of said clamp bars, said frame members and said clamp bars being channel-shaped, said clamp bars being connected to said frame members by nut and bolt assemblies slidably received in the channels of said frame members, and said clamping elements comprising nut and bolt assemblies slidably received in the channels of said clamp bars.

15. Apparatus for manipulating the upper and lower dies of a die set for maintenance procedures, comprising means providing a working-transfer station, a main frame adjacent said work-transfer station, a fixture, means mounting said fixture on said main frame for up and down movement away from and toward said work-transfer station, a sub-frame, means mounting said sub-frame on said fixture for rotation about a horizontal axis, clamping means on said sub-frame to clamp the upper die of a die set at said work-transfer station when said fixture is in a lower position, means for raising said fixture to pick up and elevate said upper die to an upper position and for rotating said sub-frame to turn said upper die, support means having a table for supporting the die set at said work-transfer station for pick-up of the upper die, clamping means for clamping the lower die to said table, means mounting said table for rotation about a horizontal axis, and means for rotating said table after pick-up of said upper die to turn the lower die clamped thereto.

16. Apparatus as defined in claim 15, including means for raising and lowering said table relative to said support means, said table being rotated as aforesaid in the raised position of said table.

17. Apparatus as defined in claim 15, wherein said support means is a cart capable of advancing the die set to the work-transfer station for pick-up of the upper die and withdrawing the lower die after pick-up of the upper die.

* * * * *